US006465997B2

(12) United States Patent
Kussener

(10) Patent No.: US 6,465,997 B2
(45) Date of Patent: Oct. 15, 2002

(54) REGULATED VOLTAGE GENERATOR FOR INTEGRATED CIRCUIT

(75) Inventor: Edith Kussener, Aix-en-Provence (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 09/953,071

(22) Filed: Sep. 14, 2001

(65) Prior Publication Data

US 2002/0109491 A1 Aug. 15, 2002

(51) Int. Cl.[7] ..... G05F 3/16
(52) U.S. Cl. ..... 323/313; 323/907
(58) Field of Search ..... 323/312, 313, 323/314, 315, 281, 907; 327/539, 535, 513, 538

(56) References Cited

U.S. PATENT DOCUMENTS 4,532,468 A * 7/1985 Nishida et al. ..... 323/367
4,820,967 A * 4/1989 Kertis et al. ..... 323/314
4,939,442 A * 7/1990 Carvajal et al. ..... 323/281
5,061,862 A 10/1991 Tamagawa ..... 307/296.1
5,367,249 A * 11/1994 Honnigford ..... 323/313
5,686,823 A * 11/1997 Rapp ..... 323/313
5,796,244 A 8/1998 Chen et al. ..... 323/313
5,856,742 A 1/1999 Vulih et al. ..... 323/315
5,966,039 A * 10/1999 Koglin et al. ..... 327/356
5,990,672 A * 11/1999 Giacomini ..... 323/313
6,075,354 A * 6/2000 Smith et al. ..... 323/313
6,150,872 A * 11/2000 McNeill et al. ..... 327/539
6,175,224 B1 * 1/2001 Kadanka ..... 323/281
6,225,856 B1 * 5/2001 Toth ..... 327/539
6,232,828 B1 * 5/2001 Smith et al. ..... 327/539
6,362,612 B1 * 3/2002 Harris ..... 323/312

* cited by examiner

*Primary Examiner*—Adolf Deneke Berhane
(74) *Attorney, Agent, or Firm*—Lisa K. Jorgenson; Allen, Dyer, Doppelt, Milbrath & Gilchrist, P.A.

(57) ABSTRACT

A regulated voltage generator provides different regulated voltages to an integrated circuit. The regulated voltage generator includes a bandgap reference circuit and at least one gain stage connected to an output thereof. The output voltage of the bandgap reference circuit varies as a function of temperature to compensate for variations in the gain stage made up of first and second transistors. A regulated voltage output by the regulated voltage generator is independent of temperature and of the supply voltage. The value of the regulated voltage is adjusted via a load resistor and via the first and second transistors along with an output transistor of the bandgap reference circuit.

31 Claims, 1 Drawing Sheet

REGULATED VOLTAGE GENERATOR FOR INTEGRATED CIRCUIT

FIELD OF THE INVENTION

The present invention relates to integrated circuits, and more particularly, to voltage generators which provide different reference voltages required for supplying integrated circuits.

BACKGROUND OF THE INVENTION

External power supplies for integrated circuits now vary between three volts and ten volts, whereas the voltages required by the internal power supplies for the electrical circuits within the integrated circuits are, depending on the application, 2.5 volts, 3 volts, 5 volts and 7 volts. These voltages are within ±10%. It is therefore imperative that an integrated circuit itself generate these different voltages in order that they be independent of the power supply voltage and of temperature. For instance, the temperature may vary between −40° C. and 125° C.

To this end, there has been proposed a regulated voltage generator which exploits the properties of a reference voltage given by a circuit described in an article by E. Vittoz and J. Fellrath, entitled "CMOS Analog Integrated Circuits Based on Weak Inversion Operation", published in IEEE Journal of Solid State Circuits, Vol. SC-12, no. 3, 1997, pages 224–231. This voltage reference circuit is generally known as a bandgap voltage reference circuit.

This prior art circuit supplies a reference voltage of 1.28 volts, known as the bandgap voltage, which is constant over a wide range of supply voltages and temperatures. To obtain the different required voltages, the circuit's output voltage is applied to gain stages, with each gain stage producing one of the required voltages.

However, these gain stages are sensitive to the supply voltage and to temperature, and the same holds for the power stage that follows them for supplying the required power. As a result, the voltages supplied vary significantly as a function of power supply voltage and of the temperature.

SUMMARY OF THE INVENTION

An object of the present invention is to provide a generator for at least one regulated voltage that is not very sensitive to variations over a wide range of power supply voltages and temperatures.

This object is achieved by using a potential barrier reference voltage circuit, known as a bandgap type of circuit, and at least one gain stage. To provide a regulated voltage generator that is not sensitive to variations in the power supply voltage and temperature, the characteristics of the reference voltage are degraded to compensate for the variations due to the gain stage. The reference voltage then delivers a voltage which is a function of temperature variations opposite to that of the gain stage.

Another object of the present invention is to provide a generator producing a plurality of regulated voltages by implementing several gain stages.

The invention thus relates to a regulated voltage generator for supplying at least one regulated voltage to an integrated circuit comprising a bandgap type of reference voltage circuit and at least one gain stage. The bandgap type of reference voltage circuit comprises a current generator which supplies a bipolar transistor configured as a diode via a load resistor connected to the emitter of the bipolar transistor.

The gain stage comprises two MOS transistors in series between the supply voltage and a ground potential. The gate of a first transistor is connected to the gate of the output transistor of the current generator, and the gate of the second transistor is connected to the output of the bandgap type reference voltage circuit.

The characteristics of the first and second transistors are chosen to obtain the regulated voltage. The value of the load resistor is chosen such that the emitter-base voltage of the bipolar transistor varies with temperature in a manner to compensate for the variation of the gate-source voltage of the second transistor as a function of temperature.

BRIEF DESCRIPTION OF THE DRAWINGS

Other characteristics and advantages of the present invention shall become more apparent from reading the following description of the preferred embodiments, given with reference to the appended drawings in which.

DETAILED DESCRIPTION OF THE PREFERRED EMBODIMENTS

Figure 1:
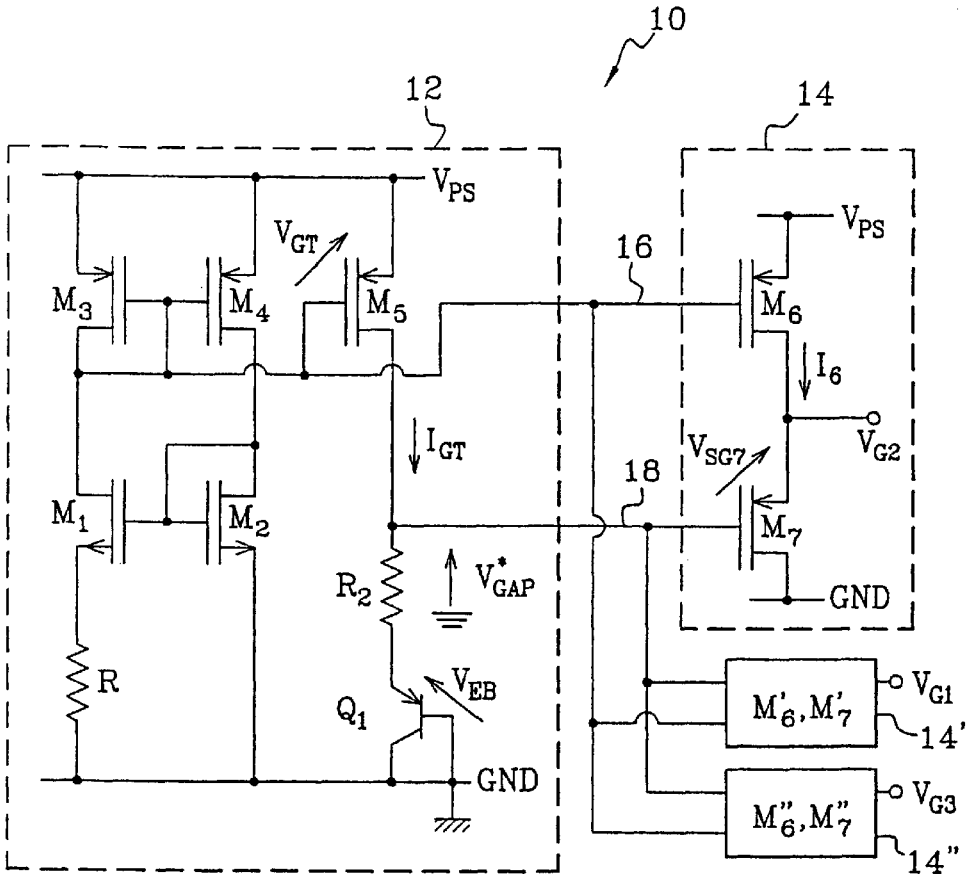
FIG. 1 is a schematic circuit diagram of a regulated voltage generator in accordance with the present invention.

The regulated voltage generator 10 in accordance with the invention comprises (FIG. 1) a bandgap (potential barrier) reference voltage circuit 12 and at least one gain stage 14. The circuit 12 comprises four transistors M1, M2, M3 and M4 which are connected in a closed loop.

Transistors M1 and M2 are N-type MOS transistors whose sources are connected to a terminal at ground potential GND, either directly for transistor M2, or via a resistor R for transistor M1. The gates of transistors M1 and M2 are connected to one another and to the drain of transistor M2, which is connected to the drain of MOS transistor M4. Transistor M4 is a P-type transistor, and its source is connected to the supply voltage $V_{PS}$. The gate of transistor M4 is connected to the gate and to the drain of MOS transistor M3, which is a P-type transistor, and is connected to the drain of transistor M1. The source of transistor M3 is connected to the supply voltage $V_{PS}$.

The gates of transistors M3 and M4 are connected to the gate of a P-type MOS transistor M5 whose source is connected to the supply voltage $V_{PS}$. The drain of transistor M5 is connected to the ground potential GND via a resistor $R_2$, and a PNP type bipolar transistor Q1 is connected as a diode. Bipolar transistor Q1 has its emitter connected to a terminal of resistor $R_2$ while its other two electrodes are connected to the ground potential GND so that it functions as a diode.

The bandgap type reference voltage circuit 12 has two output terminals 16 and 18. One output terminal 16 corresponds to the common node of the gates of transistors M3, M4 and M5, and the other output terminal 18 corresponds to the drain of transistor M5.

The gain stage 14 comprises two P-type MOS transistors M6 and M7. The gate of transistor M6 is connected to output terminal 16, while the gate of transistor M7 is connected to output terminal 18. The source of transistor M6 is connected to the supply voltage $V_{PS}$, while its drain is connected to the source of transistor M7. The drain of transistor M7 is connected to the ground potential GND. The regulated output voltage $VG_2$ is taken from the terminals of transistor M7, i.e., between the ground potential GND and the source of transistor M7.

Transistors M1 to M5 and resistor R form a current source producing a current $I_{GT}$. This current is supplied by transistor M5, and flows through resistor $R_2$ and bipolar transistor Q1. Transistor Q1 is connected as a PN diode, and the current IGT varies proportionally with temperature.

In a prior art bandgap type of reference voltage circuit, the value of $R_2$ is chosen to produce a voltage $V_{GAP}\approx 1.28$ volts at the terminals of Q1 and $R_2$, which is not sensitive to temperature. This voltage $V_{GAP}$ is used in the gain stage 14 to obtain the required voltage $VG_{G2}$, which is greater than $V_{GAP}$.

In this gain stage, since the output voltage $VG_{G2}$ is the sum of $V_{GAP}$ and the voltage $V_{SG7}$ between the gate and the source of transistor M7, with $V_{SG7}$ varying with temperature, $V_{G2}$ also varies with temperature.

The invention includes making $V_{GAP}$ vary, so that it becomes $V^*_{GAP}$, as a function of temperature in order to compensate for the variation of $V_{SG7}$ as a function of temperature. This is obtained by adjusting the value of resistor $R_2$ and the sizes of transistors M5, M6 and M7.

To this end, a first equation defines the current $I_{GT}$:

$$I_{GT}(T)\approx I_{GT}(T_0)\times(T/T_0) \quad (1)$$

with the temperature T being expressed as an absolute value, and the temperature To being the reference temperature of 27° C.

A second equation defines the output voltage $V_{G2}$ such that:

$$V_{G2}=V^*_{GAP}+V_{SG7}\approx V_{EB}+R_2I_{GT}+V_{T7}\eta_2\sqrt{I_{GT}} \quad (2)$$

where $V_{EB}$ is the emitter-base voltage of transistor Q1, $\eta_2$ is a term which depends on the W/L coefficients of transistors M5, M6 and M7, $V_{T7}$ is an intrinsic characteristic voltage of transistor M7, referred to as the threshold voltage, and $V^*_{GAP}$ is the variable voltage which depends on the temperature at the terminals of resistor $R_2$ and of bipolar transistor $Q_1$. This is the output voltage of the bandgap reference voltage stage.

A third equation defines the variation of 72 $_2$ as a function of temperature:

$$\eta_2(T)\approx\eta_2(T_0)(T_0/T)^m \quad (3)$$

with m being in the region of two.

These three equations (1), (2) and (3) make it possible to determine the values of $\eta_2$ and $R_2$ by the following formulas:

$$\eta_2\approx 0.4[(V_{G2}-V_{EB}+V_{V7})-T_0(\delta V_{EB}/\delta T)]/[\sqrt{I_{GT}(T_0)}] \quad (4a)$$

$$R_2=0.2[3(V_{G2}-V_{EB}+V_{T7})+2T_0(\delta V_{EB}/\delta T)]/[I_{GT}(T_0)] \quad (4b)$$

with $\delta V_{EB}/\delta T$ being in the region of 1.8 mV/°C.

These two formulas lead to values of $R_2$=550 kΩ and $\eta_2$=493 to obtain a value $V_{G2}$=2.94 volts, which varies by 300 μV/° C., that is 49.5 mV in the temperature range of −40° C. to +125° C. for $V_{PS}$=10 volts.

The voltage $V^*_{GAP}$ can be used to obtain other voltages $V_{G1}$ and $V_{G3}$ by applying that voltage to two gain stages 14' and 14" in which the transistors M'6, M'7 and M"6, M"7 are determined by the coefficients $\eta_1$ and $\eta_3$ calculated using formula (4a). Calculated values of $\eta_2$=493 for $V_{G1}$=2.46 volts and $\eta_3$=635 for $VG_{G3}$=3.43 volts are provided, for example.

However, these voltages $V_{G1}$ and $V_{G3}$ are sensitive to temperature variations, on the order of a millivolt per degree Celsius. To obtain a voltage $V_{G1}$ or $V_{G3}$ that would not be sensitive to temperature, it would be necessary to modify $R_2$ according to formula (4b) to obtain $R_1$, for the case of voltage $V_{G1,}$ and $R_3$ for the case of voltage $VG_3$.

Moreover, coefficient $\eta_2$ not only determines the characteristics of transistors M6 and M7, but also transistor of M5 according to the formula:

$$\eta_2=\frac{[W6\cdot L5/W5\cdot L6]^{1/2}}{[\mu 7\cdot Cox(W7/L7)]^{1/2}}$$

where:

W and L are respectively the width W and the length L of the drain-source channel of transistors M5 (W5 and L5), M6 (W6, L6) and M7 (W7, L7), μ7 is the mobility of transistor M7, and Cox is the oxide capacitance.

Figure 2:
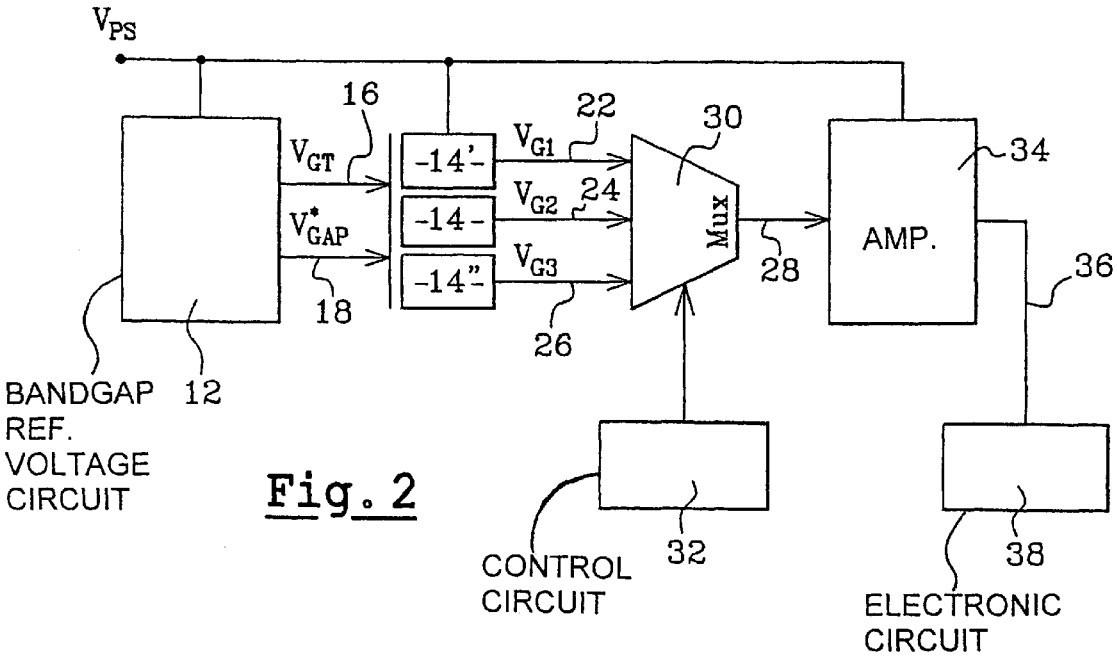
FIG. 2 is a block diagram of a device which delivers a regulated voltage among several available voltages in accordance with the present invention.

FIG. 2 is a functional block diagram of a device which supplies one of the three voltages $V_{G1}$, $V_{G2}$ or $V_{G3}$ on demand. This device comprises the bandgap type reference voltage circuit 12 of the diagram in FIG. 1, and supplies on output terminal 18 the voltage $V^*_{GAP}$ as well as the voltage $V_{GT}$ of transistor M5 on output terminal 16. Output terminals 16 and 18 are connected to the input terminals of the gain stages 14', 14 and 14", which respectively supply the voltages $V_{G1}$, $V_{G2}$ and $V_{G3}$.

Only the voltage $V_{G2}$ which corresponds to the value $R_2$ calculated from formula (4b) is in fact regulated, and hence substantially independent of temperature variations. The output terminals of gain stages 14', 14 and 14" are each connected to one of three input terminals 22, 24, 26 of a multiplexing circuit 30 which produces the connection between one of the three input terminals 22, 24, 26 and its output terminal 28. Selection of the connection is obtained by a control circuit 32 using appropriate signals.

The output terminal 28 of the multiplexing circuit 30 is connected to the input terminal of a power amplifier 34, whose output terminal 36 is connected to an electronic circuit to be supplied, such as a microprocessor 38, for example.

What is claimed is:

1. A regulated voltage generator for supplying at least one regulated voltage to an integrated circuit, the regulated voltage generator comprising:

a bandgap reference voltage circuit comprising a load resistor, a bipolar transistor configured as a diode and including an emitter connected to said load resistor, and a current generator comprising an output transistor for supplying a current to said bipolar transistor via said load resistor; and at least one gain stage connected to an output of said bandgap reference voltage circuit for supplying the at least one regulated voltage, said at least one gain stage comprising a first MOS transistor including a gate connected to a gate of said output transistor, and a second MOS transistor connected in series to said first MOS transistor between a supply voltage and a voltage reference, said second MOS transistor including a gate connected to the output of said bandgap reference voltage circuit, characteristics of said first and second transistors determining the at least one regulated voltage, said load resistor having a value so that an emitter-base voltage of said bipolar transistor varies with temperature to compensate for a variation of a gate-source voltage of said second transistor as a function of temperature.

2. A regulated voltage generator according to claim 1, wherein the characteristics ($\eta_2$) of said first and second MOS transistors are defined by the formula:

$$\eta_2 \approx 0.4[(V_{G2}-V_{EB}+V_{T7})-T_0(\delta V_{EB}/\delta T)]/[\sqrt{I_{GT}(T_0)}]$$

in which:

$V_{G2}$ is a value of the at least one regulated voltage to be obtained, $V_{EB}$ is the emitter-base voltage of said bipolar transistor, $V_{T7}$ is a threshold voltage of said second MOS transistor M7, $T_0$ is a reference temperature, $I_{GT}$ is a current supplied by said current generator, and $\delta V_{EB}/\delta T$ is a variation of the emitter-base voltage $V_{EB}$ as a function of temperature T.

3. A regulated voltage generator according to claim 2, wherein the value of said load resistor ($R_2$) is defined by the formula:

$$R_2 = 0.2[3(V_{G2}-V_{EB}+V_{T7})+2T_0(\delta V_{EB}/\delta T)]/[I_{GT}(T_0)].$$

4. A regulated voltage generator according to claim 1, wherein said at least one gain stage comprises a plurality of gain stages, with each gain stage providing a respective regulated voltage, the regulated voltage generator further comprising:

a multiplexing circuit connected to said plurality of gain stages for receiving the plurality of regulated voltages; and a control circuit connected to said multiplexing circuit for selecting one of the plurality of regulated voltages for output.

5. A regulated voltage generator according to claim 4, further comprising a power amplifier connected to an output of said multiplexing circuit for amplifying the regulated voltage selected by said control circuit.

6. A voltage generator for supplying at least one regulated voltage and comprising:

a bandgap reference voltage circuit comprising a load resistor, a load transistor connected to said load resistor, and a current generator comprising an output transistor for supplying a current to said load transistor via said load resistor; and at least one gain stage connected to an output of said bandgap reference voltage circuit for supplying the at least one regulated voltage, said at least one gain stage comprising a first transistor including a control terminal connected to a control terminal of said output transistor, and a second transistor connected in series to said first transistor between a supply voltage and a voltage reference, said second transistor including a control terminal connected to the output of said bandgap reference voltage circuit, said load resistor having a value so that a conducting terminal/control terminal voltage of said load transistor varies with temperature to compensate for a variation of a control terminal/conducting terminal voltage of said second transistor as a function of temperature.

7. A regulated voltage generator according to claim 6, wherein said load transistor comprises a bipolar transistor including a base, an emitter and a collector, with the collector and base being connected together so that said load transistor is configured as a diode, and with the emitter being connected to said load resistor.

8. A regulated voltage generator according to claim 7, wherein the conducting terminal/control terminal voltage of said load transistor comprises an emitter-base voltage thereof.

9. A regulated voltage generator according to claim 6, wherein said first and second transistors each comprises a MOS transistor.

10. A regulated voltage generator according to claim 9, wherein said second MOS transistor includes a gate and a source, and wherein the control terminal/conducting terminal voltage of said second MOS transistor comprises a gate-source voltage thereof.

11. A regulated voltage generator according to claim 6, wherein the characteristics ($\eta_2$) of said first and second transistors are defined by the formula:

$$\eta_2 \approx 0.4[(V_{G2}-V_{EB}+V_{T7})-T_0(\delta V_{EB}/\delta T)]/[\sqrt{I_{GT}(T_0)}]$$

in which:

$V_{G2}$ is a value of the at least one regulated voltage to be obtained, $V_{EB}$ is the conducting terminal/control terminal voltage of said load transistor, $V_{T7}$ is a threshold voltage of said second transistor M7, $T_0$ is a reference temperature, $I_{GT}$ is a current supplied by said current generator, and $\delta V_{EB}/\delta T$ is a variation of the conducting terminal/control terminal voltage of said load transistor voltage $V_{EB}$ as a function of temperature T.

12. A regulated voltage generator according to claim 6, wherein the value of said load resistor ($R_2$) is defined by the formula:

$$R_2 = 0.2[3(V_{G2}-V_{EB}+V_{T7})+2T_0(\delta V_{EB}/\delta T)]/[I_{GT}(T_0)].$$

13. A regulated voltage generator according to claim 6, wherein said at least one gain stage comprises a plurality of gain stages, with each gain stage providing a respective regulated voltage, the regulated voltage generator further comprising:

a multiplexing circuit connected to said plurality of gain stages for receiving the plurality of regulated voltages; and a control circuit connected to said multiplexing circuit for selecting one of the plurality of regulated voltages for output.

14. A regulated voltage generator according to claim 13, further comprising a power amplifier connected to an output of said multiplexing circuit for amplifying the regulated voltage selected by said control circuit.

15. An electronic circuit for supplying a plurality of regulated voltages and comprising:

a bandgap reference voltage circuit comprising a load resistor, a load transistor connected to said load resistor, and a current generator comprising an output transistor for supplying a current to said load transistor via said load resistor; and a plurality of gain stages connected to an output of said bandgap reference voltage circuit for providing the plurality of regulated voltages, each gain stage comprising a first transistor including a control terminal connected to a control terminal of said output transistor, and a second transistor connected in series to said first transistor between a supply voltage and a voltage reference, said second transistor including a control terminal connected to an output of said bandgap reference voltage circuit, said load resistor having a value so that a conducting terminal/control terminal voltage of said load transistor varies with temperature to compensate for a variation of a control terminal/conducting terminal voltage of said second transistor as a function of temperature;

a multiplexing circuit connected to said plurality of gain stages for receiving the plurality of regulated voltages; and a control circuit connected to said multiplexing circuit for selecting one of the plurality of regulated voltages for output.

16. An electronic circuit according to claim 15, wherein said load transistor comprises a bipolar transistor including a base, an emitter and a collector, with the collector and base being connected together so that the load transistor is configured as a diode, and with the emitter being connected to said load resistor.

17. An electronic circuit according to claim 16, wherein the conducting terminal/control terminal voltage of said load transistor comprises an emitter-base voltage thereof.

18. An electronic circuit according to claim 15, wherein said first and second transistors each comprises a MOS transistor.

19. An electronic circuit according to claim 18, wherein said second MOS transistor includes a gate and a source, and wherein the control terminal/conducting terminal voltage of said second MOS transistor comprises a gate-source voltage thereof.

20. An electronic circuit according to claim 15, wherein the characteristics ($\eta_2$) of said first and second transistors are defined by the formula:

$$\eta_2 \approx 0.4[(V_{G2}-V_{EB}+V_{T7})-T_0(\delta V_{EB}/\delta T)]/[\sqrt{I_{GT}(T_0)}]$$

in which:

$V_{G2}$ is a value of the at least one regulated voltage to be obtained, $V_{EB}$ is the conducting terminal/control terminal voltage of said load transistor, $V_{T7}$ is a threshold voltage of said second transistor M7, $T_0$ is a reference temperature, $I_{GT}$ is a current supplied by said current generator, and $\delta V_{EB}/\delta T$ is a variation of the conducting terminal/control terminal voltage of said load transistor voltage $V_{EB}$ as a function of temperature T.

21. An electronic circuit according to claim 15, wherein the value of said load resistor ($R_2$) is defined by the formula:

$$R_2=0.2\,[3(V_{G2}-V_{EB}+V_{T7})+2T_0(\delta V_{EB}/\delta T)]/[I_{GT}(T_0)].$$

22. A method for making a voltage generator for supplying at least one regulated voltage, the method comprising:

providing a bandgap reference voltage circuit comprising a load resistor, a load transistor connected to the load resistor, and a current generator comprising an output transistor for supplying a current to the load transistor via the load resistor;

providing at least one gain stage comprising a first transistor including a control terminal connected to a control terminal of the output transistor, and a second transistor connected in series to the first transistor between a supply voltage and a voltage reference, the second transistor including a control terminal connected to an output of the bandgap reference voltage circuit; and choosing a value of the load resistor such that a conducting terminal/control terminal voltage of the load transistor varies with temperature to compensate for a variation of a control terminal/conducting terminal voltage of the second transistor as a function of temperature.

23. A method according to claim 22, further comprising choosing characteristics of the first and second transistors to obtain the at least one regulated voltage at an output of the at least one gain stage.

24. A method according to claim 22, wherein the load transistor comprises a bipolar transistor including a base, an emitter and a collector, with the collector and base being connected together so that the load transistor is configured as a diode, and with the emitter being connected to the load resistor.

25. A method according to claim 24, wherein the conducting terminal/control terminal voltage of the load transistor comprises an emitter-base voltage thereof.

26. A method according to claim 22, wherein the first and second transistors each comprises a MOS transistor.

27. A method according to claim 26, wherein the second MOS transistor includes a gate and a source, and wherein the control terminal/conducting terminal voltage of the second MOS transistor comprises a gate-source voltage thereof.

28. A method according to claim 22, wherein the characteristics ($\eta_2$) of the first and second transistors are defined by the formula:

$$\eta_2 \approx 0.4[(V_{G2}-V_{EB}V_{T7})-T_0(\delta V_{EB}/\delta T)]/[\sqrt{I_{GT}(T_0)}]$$

in which:

$V_{G2}$ is a value of the at least one regulated voltage to be obtained, $V_{EB}$ is the conducting terminal/control terminal voltage of the load transistor, $V_{T7}$ is a threshold voltage of the second transistor M7, $T_0$ is a reference temperature, $I_{GT}$ is a current supplied by the current generator, and $\delta V_{EB}/\delta T$ is a variation of the conducting terminal/control terminal voltage of the load transistor voltage $V_{EB}$ as a function of temperature T.

29. A method according to claim 22, wherein the value of the load resistor ($R_2$) is defined by the formula:

$$R_2=0.2[3(V_{G2}-V_{EB}+V_{T7})+2T_0(\delta V_{EB}/\delta T)]/[I_{GT}(T_0)].$$

30. A method according to claim 22, wherein the at least one gain stage comprises a plurality of gain stages, with each gain stage providing a respective regulated voltage, the method further comprising:

connecting a multiplexing circuit to the plurality of gain stages for receiving the plurality of regulated voltages; and connecting a control circuit to the multiplexing circuit for selecting one of the plurality of regulated voltages for output.

31. A method according to claim 30, further comprising connecting a power amplifier to an output of the multiplexing circuit for amplifying the regulated voltage selected by the control circuit.

* * * * *

UNITED STATES PATENT AND TRADEMARK OFFICE

CERTIFICATE OF CORRECTION

PATENT NO. : 6,465,997 B2
DATED : October 15, 2002
INVENTOR(S) : Edith Kussener

It is certified that error appears in the above-identified patent and that said Letters Patent is hereby corrected as shown below:

Title page,
Item [30] Foreign Application Priority Data, insert -- FR 0011800 Filed September 15, 2000 --

Signed and Sealed this

Twentieth Day of May, 2003

JAMES E. ROGAN
*Director of the United States Patent and Trademark Office*